United States Patent [19]

Sprague

[11] 4,336,940

[45] Jun. 29, 1982

[54] GOLF TEE HOLDER

[76] Inventor: Boyd F. Sprague, 16595 SW. Monterey La., Tigard, Oreg. 97223

[21] Appl. No.: 172,675

[22] Filed: Jul. 28, 1980

[51] Int. Cl.[3] ..... A63B 69/36; A63B 57/00

[52] U.S. Cl. ..... 273/208

[58] Field of Search ..... 273/33, 208, 209, 201, 273/202, 203, 204, 205, 206, 207, 210, 211, 212, 26 R, 26 B

[56] References Cited

U.S. PATENT DOCUMENTS

| | | | |
|---|---|---|---|
| 1,670,123 | 5/1928 | Ranseen | 273/209 |
| 2,608,409 | 8/1952 | Pinkerton | 273/26 B |
| 2,668,710 | 2/1954 | Carlson | 273/208 |
| 3,623,724 | 11/1971 | Lande | 273/26 B |
| 3,744,801 | 7/1973 | Marriott | 273/208 |
| 4,114,878 | 9/1978 | Hammond | 273/208 |

FOREIGN PATENT DOCUMENTS

| | | | |
|---|---|---|---|
| 619527 | 1/1927 | France | 273/208 |
| 368568 | 3/1932 | United Kingdom | 273/208 |
| 9947 | 11/1932 | United Kingdom | 273/208 |

*Primary Examiner*—Richard C. Pinkham
*Assistant Examiner*—T. Brown
*Attorney, Agent, or Firm*—James D. Givnan, Jr.

[57] ABSTRACT

The golf tee holder includes a generally cylindrical body for reception of an inserted golf tee. The holder is retained against displacement by a tether shown attached to a ground inserted anchor. The body of the tee holder is shouldered at its upper end for confinement of the tee head. An annular groove about the holder body permits winding of the tether thereon in a convenient manner. Lengthwise grooves in the holder body slidably receive the legs of a bifurcated anchor which legs also prevent unwinding of the tether during non-use of the holder. The holder body is slotted at its upper end to facilitate tee insertion and removal.

3 Claims, 3 Drawing Figures

GOLF TEE HOLDER

BACKGROUND OF THE INVENTION

The present invention concerns a device within which a golf tee is insertable with provision made for tethering the tee and holder to prevent loss.

In the prior art are tee holding devices such as that disclosed in U.S. Pat. No. 1,670,123 which shows a tethered tee holder with no provision made for tee reinforcement or tether storage; U.S. Pat. Nos. 1,638,448 and 1,550,483 disclose devices which are not usable with conventional golf tees nor do they provide for tether storage, and; U.S. Pat. No. 3,406,978 which discloses a hinged golf tee.

The general concept of a golf tee holder with a tethered anchor is admittedly old per the first mentioned patent.

SUMMARY OF THE PRESENT INVENTION

The present invention is embodied within a tee holder within which the above ground segment of the golf tee is housed.

An apertured body receives an inserted tee with the tee head downwardly confined by an overlying shoulder. The body additionally supports the ground inserted tee by a body bottom wall for abutment with the ground surface. The body is annularly recessed to receive a wound tether or line with grooves in the body receiving a bifurcated tether anchor. The body may be slotted to facilitate radial expansion of the body during tee insertion.

Important objects include the provision of a golf tee holder encompassing the above ground portion of the tee and facilitating insertion of the tee into the ground by providing additional area for the thumb to act on; the provision of a tee holder the base of which engages the ground surface to stabilize the tee; the provision of a tee holder with provision made for storing a tether line coiled thereabout in a body recess; the provision of a tee holder having lengthwise directed grooves to receive the legs of a bifurcated tether anchor; the provision of a tee holder having a ground insertable, bifurcated anchor; the provision of a tee holder body slotted to facilitate tee insertion and removal. These and additional objects will become subsequently apparent.

DETAILED DESCRIPTION OF THE PREFERRED EMBODIMENT

Figure 1:
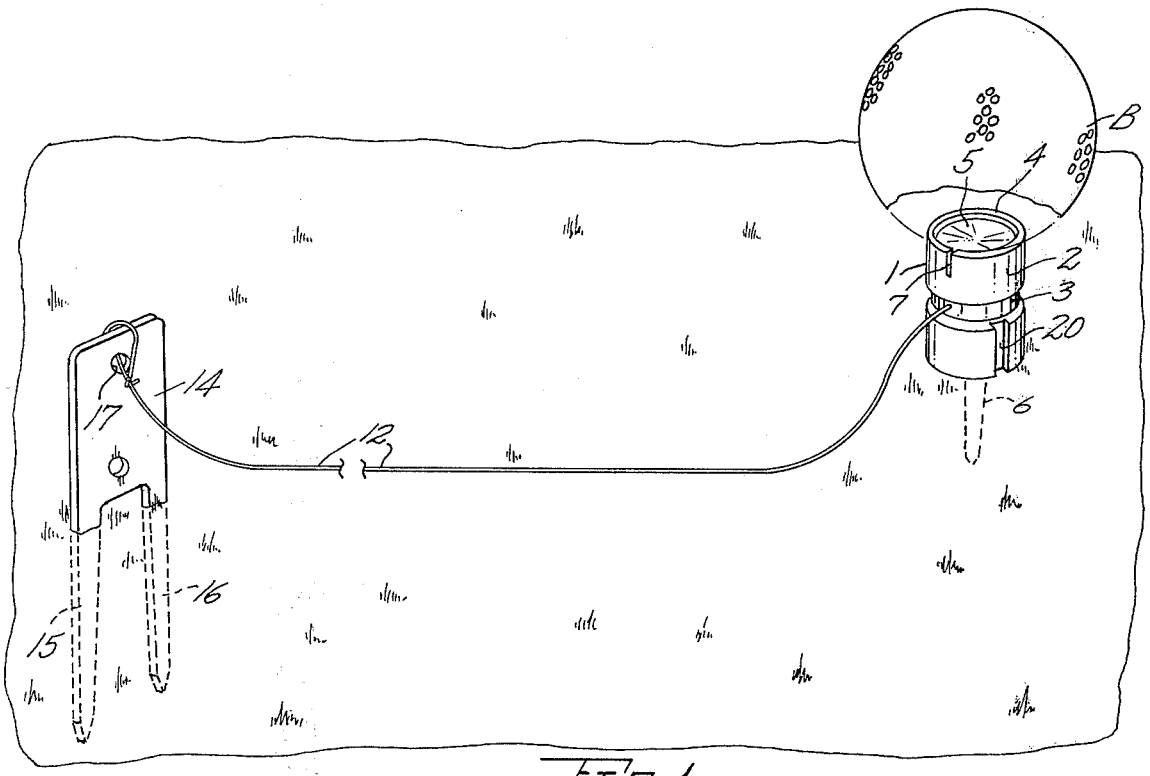
FIG. 1 is a perspective view of the present tee holder with a golf ball in place.
Figure 2:
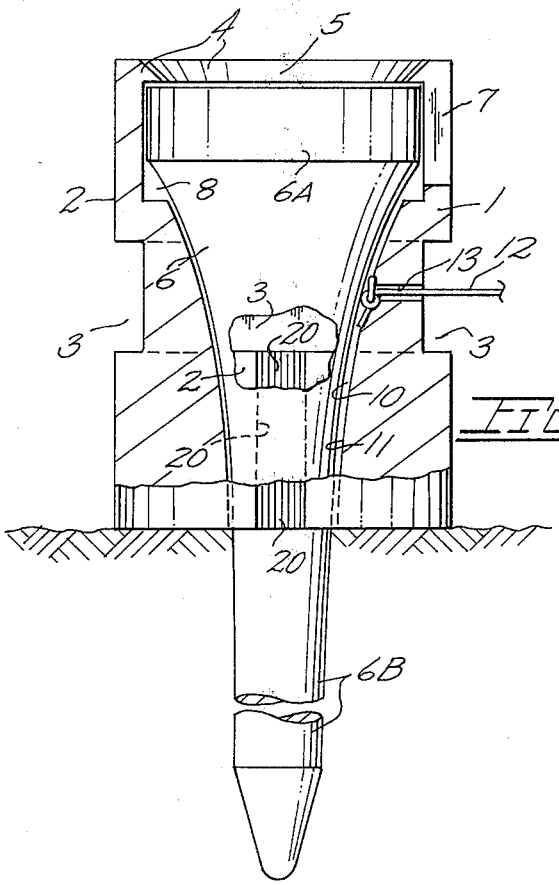
FIG. 2 is a vertical sectional view of the tee holder body with tee in place.
Figure 3:
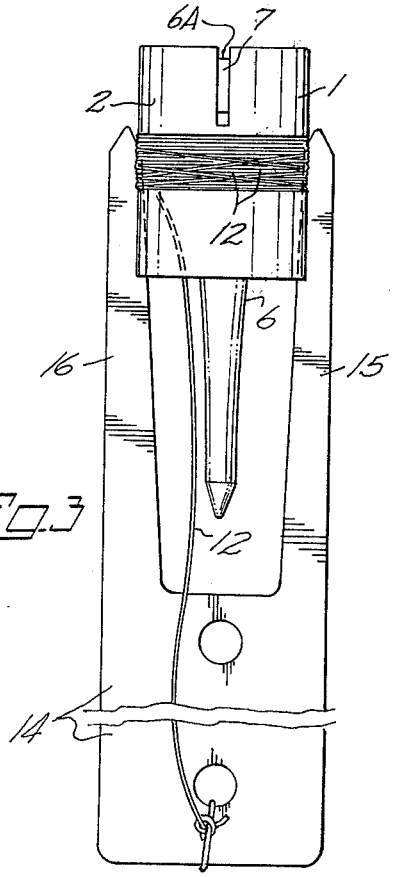
FIG. 3 is a side elevational view of the tee holder configured for stowage.

With continuing reference to the drawing, the applied reference numeral 1 indicates generally a tee holder body having an outer perimetrical wall 2 having an annular recess 3 formed therein. An uppermost shoulder at 4 defines a body opening 5 through which a golf tee 6 is inserted. Said shoulder is slotted at 7 to permit radial expansion during passage of the tee head at 6A. The tee head is received within a body area 8 which communicates with a body defined opening 10 which receives the tee shank at 6B. Said opening at 10 may be configured as tapered to permit internal body wall 11 to engage and support the tee shank.

Secured to holder body 1 is a tether 12 suitably secured as by a knotted end being interiorly of a tether receiving opening 13. Annular recess 3 is of a size to permit convenient winding of the tether thereabout in a neat recessed manner. The remaining end of the tether or line 12 is attached to an anchor 14 shown as being ground insertable by reason of two pointed legs 15 and 16. An anchor opening at 17 receives the tether. If desired, the anchor may rely on weight alone to secure the tether end.

With attention again to the holder body 1, the same defines lengthwise orientated grooves at 20 which receive the inner edges of anchor legs 15 and 16 for anchor attachment when the holder is to be carried in a pocket or golf bag compartment. Said grooves desirably extend so as to communicate with annular recess 3 to permit the anchor legs to overlie the wound tether line and hold same against unwinding. The anchor may be shaped as a green repair tool of the type widely used by golfers to remove ball made depressions from the surface of a golf course green. The tether may be of elastic material or include an elastic segment to prevent breaking.

In the embodiment shown, the body may be of molded construction of a resilient but durable material with an overall height varying between 15 mm to 25 mm to best suit individual desires for ball height and tee length. Inward or outward passage of tee head 6A past shoulder 4 is readily accomplished as the shoulder may expand by reason of shoulder slot 7. Tee insertion into the ground is facilitated by the added surface area of the shoulder on which the user's thumb may bear jointly along with the top of the tee.

In use the tee holder body 1 provides additional support for the ground inserted tee to reduce the risk of breakage from club contact. Further, tee breakage is also reduced by the tendency of the tee to be lifted from the ground during club contact with the lower edge of the tee body serving as a fulcrum. The tether 12 may also serve as a golfing aid in that it may be aligned with the desired path or flight of the ball to assist the golfer in guiding the club head along the tether immediately prior to ball contact.

While I have shown but one embodiment of the invention it will be apparent to those skilled in the art that the invention may be embodied still otherwise without departing from the spirit and scope of the invention.

Having thus described the invention, what is desired to be secured under a Letters Patent is:

1. A golf tee holder comprising, a body of a resilient nature having a lengthwise opening therethrough for inserted reception of a golf tee, said body also defining a tether receiving recess about its outer perimetrical wall, a shoulder at the upper end of said body partially overlying said opening to overlie the subjacent head of a tee inserted therein, a tether attached to said body with anchor means at the remaining end of the tether and, said anchor means being of bifurcated shape, said body perimetrical wall additionally defining lengthwise orientated grooves for stowed reception of the anchor means.

2. The holder claimed in claim 1 wherein said lengthwise orientated grooves communicate with said tether receiving recess, said anchor means having a pair of legs one each received within a lengthwise recess when the anchor means is stowed.

3. The holder claimed in claim 2 wherein said anchor means legs each partially overlie said tether receiving groove when stowed in place on said elongate body.

* * * * *